United States Patent [19]

Hein, Jr.

[11] 4,056,225

[45] Nov. 1, 1977

[54] CENTRIFUGE ROTOR FOR SEPARATING PHASES OF A LIQUID

[76] Inventor: George Norton Hein, Jr., 331 Chesham Ave., San Carlos, Calif. 94070

[21] Appl. No.: 681,312

[22] Filed: Apr. 29, 1976

[51] Int. Cl.[2] ..... B04B 7/02; B04B 9/06

[52] U.S. Cl. ..... 233/20 R; 233/1 A; 233/31; 233/46

[58] Field of Search ..... 233/1 R, 1 A, 19 R, 233/19 A, 20 R, 20 A, 21, 22, 27, 31, 37, 46

[56] References Cited

U.S. PATENT DOCUMENTS

| | | | |
|---|---|---|---|
| 3,114,655 | 12/1963 | Jiskra | 233/20 R |
| 3,239,136 | 3/1966 | Hein | 233/27 X |
| 3,810,576 | 5/1974 | Polson | 233/37 |
| 3,955,758 | 5/1976 | Loison | 233/27 X |

*Primary Examiner*—George H. Krizmanich

*Attorney, Agent, or Firm*—R. J. Steinmeyer; F. L. Mehlhoff; W. H. May

[57] ABSTRACT

A centrifuge rotor having a sealing element which automatically controls in response to the centrifugation operation the fluid communication between separate fluid mixture chambers within the rotor. The sealing element is situated within the rotor above an annular and an inner chamber used for containing a fluid mixture. When the rotor is assembled and stationary, the sealing element establishes a seal between the respective chambers. During the rotation of the rotor in a centrifuge, the centrifugally induced pressure exerted by the fluid mixture moves the sealing element, releasing the seal between the respective chambers and allowing fluid communication between the chambers. As the rotor returns to a stationary position and the centrifugally induced pressure of the fluid mixture subsides, the sealing element automatically re-establishes the seal between the respective chambers.

6 Claims, 7 Drawing Figures

FIG. 3
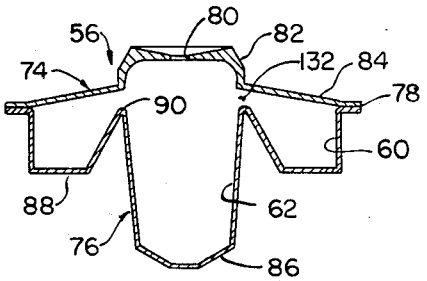
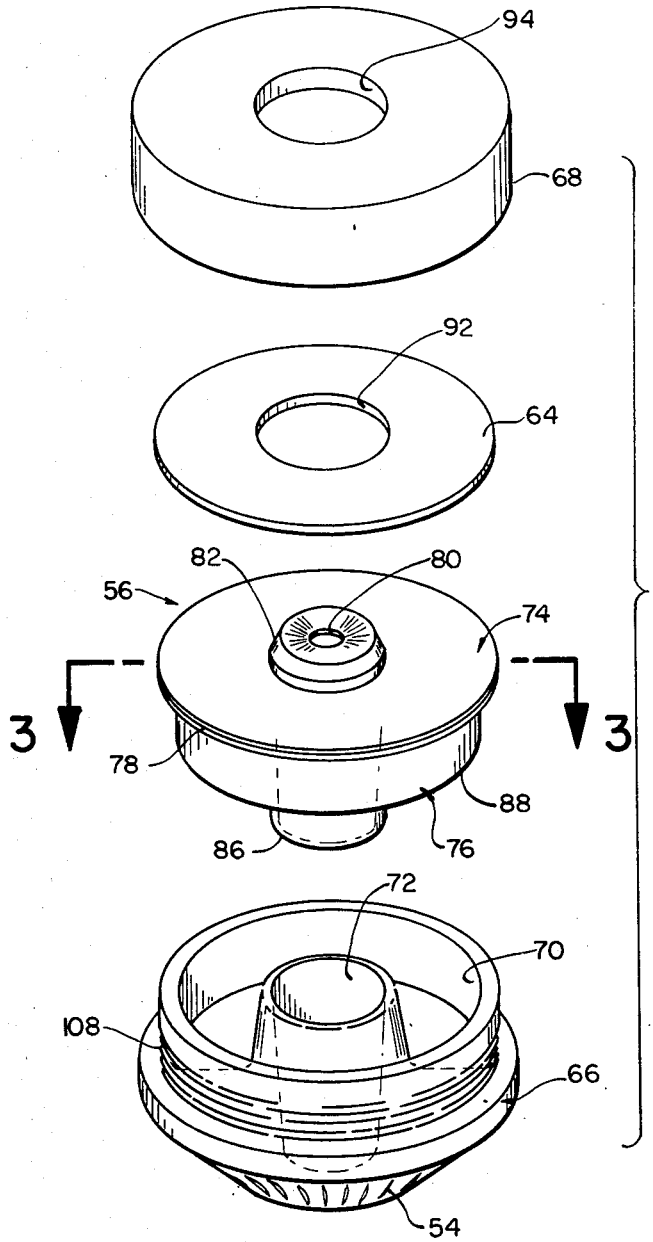
FIG. 2

CENTRIFUGE ROTOR FOR SEPARATING PHASES OF A LIQUID

BACKGROUND OF THE INVENTION

This invention relates generally to centrifuges for separating constituents of a liquid mixture and more specifically relates to a centrifuge rotor which provides for the trapping of separated constituents from the liquid mixture and automatically isolating them in a sealed chamber to prevent possible remixing with the remainder of the liquid mixture subsequent to the centrifuge operation.

By exposing certain fluid mixtures to very high speeds of rotation in a centrifuge it is possible to separate out various constituents of the mixture. An incident problem with the centrifugation operation relates to the possible remixing of the various separated constituents during the time that the rotor is decelerating to a complete stop from its high rotational speed. Consequently, various arrangements have been devised such as shown in U.S. Pat. Nos. 3,239,136 and 3,096,283 issued to George N. Hein for sealing the separated fluid constituents in an annular chamber.

As shown in the above referenced patents, the arrangements utilized to accomplish the sealing function are quite complicated and contribute to a more costly device. Further, the prior art arrangements do not operate automatically in response to the centrifugation operation to provide for both the automatic sealing and unsealing of the annular chamber. These devices require an operation independent of the centrifugation operation to seal and/or unseal the annular chamber.

SUMMARY OF THE INVENTION

The present invention comprises a sealing element which facilitates the automatic opening and closing of a seal between an annular and an inner chamber in the rotor in response to the centrifugation operation. When the rotor is stationary, the sealing element facilitates a seal between the annular chamber and the inner chamber which are part of a container or liner situated in the rotor. When the container with its respective annular and inner chambers contain a fluid mixture and it is subjected to centrifugation, the fluid mixture will exert a centrifugally induced force upon the sealing element to open the seal between the respective chambers and allow for fluid communication between those chambers.

Consequently, the higher specific gravity constituents of the fluid mixture can flow from the inner chamber toward the annular chamber during the centrifugation operation. Further, the lower specific gravity constituents of the mixture will accumulate toward the central portion of the rotor and become situated in the inner chamber. This cross flow between the respective chambers is allowed by the automatic opening of the seal between the chambers as a result of the centrifugally induced force exerted by the fluid mixture in the annular chamber against the sealing element. As the rotor slows to a stop subsequent to the centrifugation operation, the centrifugally induced force by the field mixture in the annular chamber is eliminated, resulting in the resealing of the annular chamber from the inner chamber by the sealing element. Consequently, the higher specific gravity fluid constituents will remain isolated and sealed from the remainder of the fluid mixture located in the inner chamber.

Thus, the present invention provides for the automatic sealing and unsealing between the annular and inner chambers of the rotor container through use of an uncomplicated and inexpensive device.

BRIEF DESCRIPTION OF THE DRAWINGS

FIG. 2 is an exploded perspective view of the components of the centrifuge rotor;

FIG. 3 is a sectional view taken along lines 3—3 in FIG. 2;

DETAILED DESCRIPTION OF THE INVENTION

Figure 1:
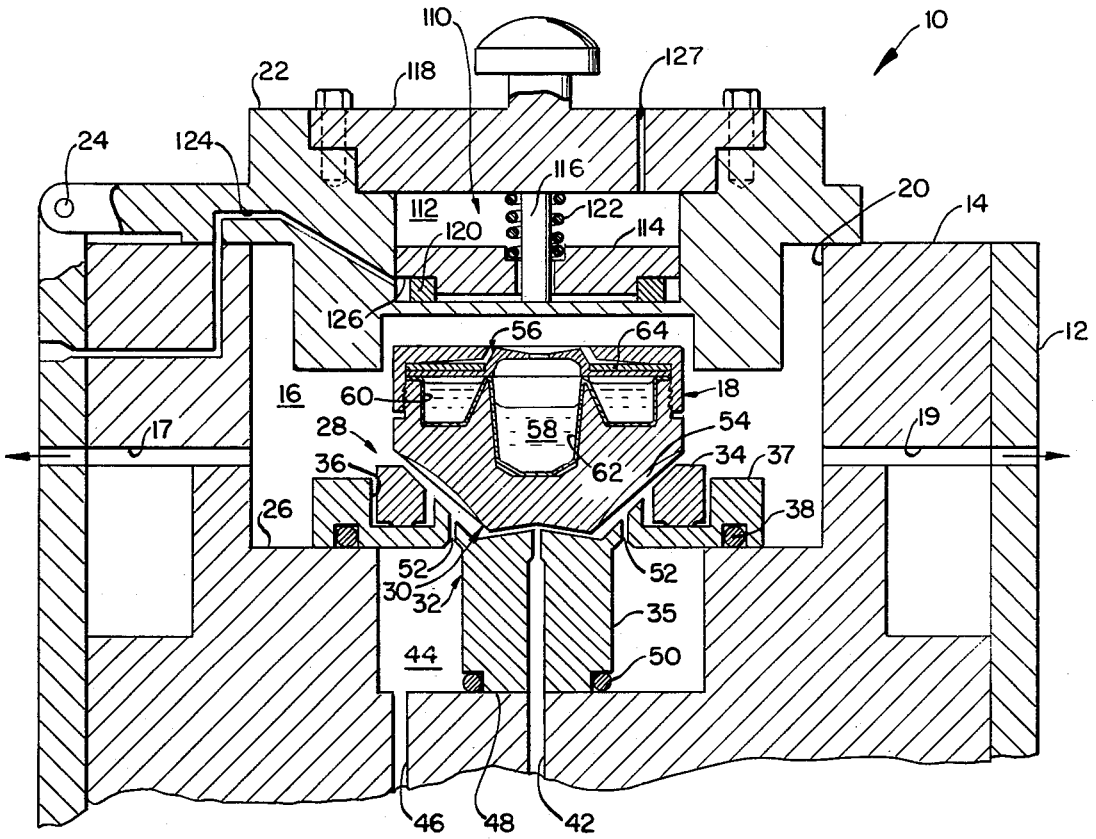
FIG. 1 is a sectional elevation view of the centrifuge apparatus.

The overall centrifuge arrangement 10 incorporating the present invention is shown in FIG. 1, having an outer casing 12 in which is mounted a housing 14. Formed within the housing 14 is a rotor chamber 16 for receipt of the rotor 18. The upper opening 20 in the housing 14 is enclosed by a cover 22 which is pivotally mounted by a pivot pin 24 on the outer casing 12. Situated at the bottom 26 of the rotor chamber 16 is a rotor seat 28 designed to receive the lower end 30 of the rotor 18. The rotor seat 28 is comprised of stator body 32 and a stator pad 34. The stator body has a central depending portion 35 and an annular portion 37. The stator pad 34 is positioned to be movable or free floating within a cavity 36 of the stator body annular portion 37. Located below the annular portion 37 of the stator body is an O-ring seal 38 which seals the stator body to the bottom 26 of the chamber 16.

Within the central depending portion 35 of the stator body 32 is a centrally disposed supporting air passage 42 in fluid communication with the rotor 18. Positioned between the stator body central depending portion 35 and the housing 14 is an annular manifold 44 which is in fluid communication with a driving air supply passage 46. A plurality of driving air jets 52 are located within the stator body 32 and are in fluid communication with the annular manifold 44. The bottom 48 of the depending portion 35 of the stator body 32 is sealed to the housing 14 by an O-ring seal 50.

Reference is made to my copending application filed on even date herein entitled An Air Levitation System For An Air Driven Centrifuge, which is directed to the more detailed configuration of the lower end 30 of the rotor as well as the rotor seat 28 which cooperatively receive an air supply through the passage 42 to support and stabilize the rotor during deceleration.

Positioned within the rotor 18 is a container 56 for receiving and holding a fluid mixture 58 within both an annular chamber 60 and an inner chamber 62. A sealing member 64 is mounted on the container 56 above the annular chamber 60 to facilitate the automatic sealing between the annular chamber 60 and the inner or central chamber 62 as will be explained herein.

The components of the rotor 18 are shown in more detail in FIG. 2. The rotor is comprised of a lower section 66 and a cap 68. The lower portion 66 of the rotor has an annular cavity 70 and a central cavity 72 which are designed to respectively receive the annular chamber 60 and inner chamber 62 of the container 56. The generally cylindrical container 56 in FIG. 3 has a top portion or cover plate 74 and a lower portion 76 which are sealed together by a circumferential seal 78. Located in the top portion 74 is a small aperture 80 through which the fluid mixture can be inserted or removed from the respective annular chamber 60 and inner chamber 62 by using, for example, a pipette (not shown). The central aperture 80 of the container 56 is located in a raised central portion 82 of the top 74. Extending radially outward from a raised central portion 82 is an annular area 84 having a slight frustoconical shape.

The lower portion 76 of the container 56 is in the form of a central well 86 surrounded by a separated annular well 88 which respectively constitute the inner and annular chambers 62 and 60. The wall of the inner chamber 62 joins with the wall of the annular chamber 60 to form a wall junction 90 between the two chambers.

The sealing element 64 in FIG. 2 is designed to be positioned closely adjacent the top portion 74 and has a central opening 92 through which fits the raised portion 82 on the top 74 of the container 56. Consequently, the diameter of the opening 92 in the sealing element 64 is slightly greater than the exterior diameter of the raised central portion 82 in the top of the container 56. Further, the overall exterior diameter of the sealing element 64 is substantially the same as the overall exterior diameter of the container 56. Therefore, the sealing element 64 mates with the top 74 of the container 56 as shown in FIG. 1. The sealing element has the general configuration of a typical bolt or screw washer. The sealing element 64 is preferably made of a semi-flexible steel or other suitable material having similar characteristics while the container 56 is preferably made of a semi-flexible plastic material or other suitable material having similar characteristics.

The cap 68 of the rotor is designed to be secured through a thread engagement with the lower portion 66 of the rotor after the container 56 and the sealing element 64 have been assembled in the orientation shown in FIG. 1. The cap 68 has a central aperture 94 which allows access to the inner chamber 62 in FIG. 1 without removal of the cap from the lower portion 64 of the rotor.

Figure 4:
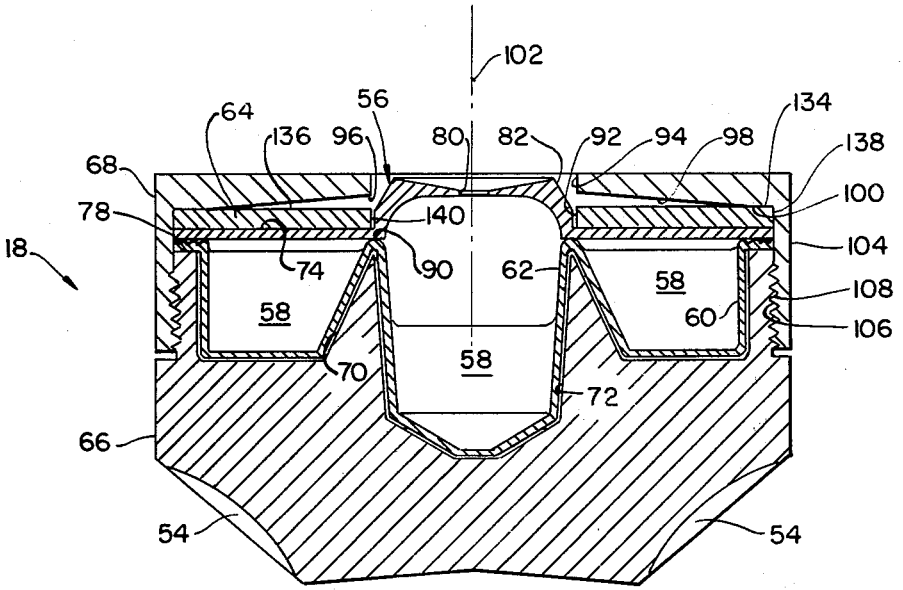
FIG. 4 is a sectional view of the rotor showing the sealed orientation of the respective chambers when the rotor is stationary.

As shown more clearly in FIG. 4, the aperture 94 in the cap 68 provides an adequate space for the accommodation of the central portion 82 of the container top 74. Further, the central aperture 94 of the cap has a depending shoulder 96 from which extends a frustoconical recessed area 98. This frustoconical area 98 within the cap 68 is designed to provide space for the flexing movement of the top 74 of container 56 as will be explained in the operation of the invention hereinafter.

The outer portion of the frustoconical area 96 of the cap 68 terminates into a flat or bearing area 100 which is substantially perpendicular to the rotor axis 102. The outer depending flange 104 of the cap 68 contains threads 106 for engagement with mating threads 108 on the lower portion 66 of the rotor 18.

As shown in FIG. 1 the centrifuge has a braking apparatus 110 within the centrifuge cover 22 to show the rotational speed of the rotor subsequent to the high speed centrifugation operation. Formed within the cover 22 is a chamber 112 in which is mounted a movable carrier 114 on a guide post 116. Access to the chamber 112 is through a removable lid 118. The carrier holds a magnet or plurality of magnets 120 and is designed to move toward and away from the rotor 18. A spring 122 mounted on the guide post 116 biases the carrier toward the rotor while a supply of air under pressure through the air passage 124 and into the annular chamber 126 forces the carrier 114 away from the rotor 18. An air vent hole 127 is located in the lid 118. Reference is made to a copending application filed on even date herewith by Douglas H. Durland, George N. Hein, Jr. and Robert J. Ehret entitled An Eddy Current Brake for an Air Driven Centrifuge, for more detail as to the structure and operation of the braking apparatus 110.

Turning to the operation of the present invention, when it is desirable, for example, to separate chyle 130 (FIG. 5) out of a fluid mixture 58 of FIG. 4 such as lipemic serum to isolate a clear serum, the fluid mixture is placed through a pipette (not shown) into the container 56 prior to its placement in the rotor 18. The pipette is inserted through the central opening 80 in the container 56 and into both the annular chamber 60 and the inner chamber 62. It should be noted as shown in FIG. 3 that, when the container 56 is not placed with the rotor 18, the general frustoconical shape of the cap portion 74 in its unrestrained condition establishes a gap 132 between it and the wall junction 90. The gap 132 is of sufficient size to allow a pipette to be inserted into the annular chamber 60 from the central opening 80. It should be noted that the annular chamber 60 is almost completely filled with the fluid mixture 58 while the inner chamber 62 is only partially filled. Once the annular and inner chambers 62 and 60 have received the fluid mixture 58, container 56 in FIG. 4 is placed within the respective annular cavity 70 and central cavity 72 of the lower portion 66 of the rotor. The sealing element 64 is positioned in juxtaposed relation with the top portion 74 of the container 56 with the central raised portion 82 extending through the central opening 92 of the sealing element. The cap 68 of the rotor is then secured to the lower portion 66 through the use of the mating threads 106 and 108.

The bearing area 100 within the cap 68 contacts a portion 134 of the upper surface 136 with respect to FIG. 4 of the sealing element 64 adjacent its outer edge 138. When the rotor cap 68 is tightly secured to the lower portion 66 of the rotor 18, a substantial force is placed on the outer portion 134 of the sealing element's upper surface 136. Because the sealing element 64 is a substantially flat member and is made from a material substantially more rigid than the material of the container 56, the free edge 140 of the sealing element in response to the force placed on the outer portion 134 of the sealing element's upper surface 136 will urge the central portion 82 of the container top 74 into engagement with the wall junction 90, sealing the annular chamber 60 from the inner chamber 62.

The rotor 18 is then placed within the centrifuge rotor chamber 16 of FIG. 1 and on the rotor seat 28. Air is introduced through the driving air passage 46 and into the annular manifold 44 where it exits through the driving jets 52 to impinge upon the rotor flutes 54 causing the rotor to rotate at very high speeds. As the rotor experiences very high rotational speed, the fluid mixture in the annular chamber 60 exerts a significant amount of pressure (arrows in FIG. 5) throughout the annular chamber as a result of the centrifugal forces acting on the fluid mixture. At a specific phase of rotation of the rotor the magnitude of the fluid mixture pressure within the annular chamber 60 forces the top portion 74 of a container 56 upward in FIG. 5 against the containing force of the sealing element 64 to open the gap 132 between the wall junction 90 and the top portion 74, permitting fluid communication between the annular chamber 60 and the inner chamber 62. The frustoconical recessed area 98 within the rotor cap 68 provides adequate space for the free end 140 of the sealing element 64 to flex away from the lower portion 76 of the container under the centrifugally induced forces of the fluid mixture. Further, the aperture 94 within the rotor cap 68 accommodates the movement of the central portion 82 of the cap 74.

Therefore, the entire fluid mixture can be subjected to the centrifugal force of the centrifugation operation throughout both the inner chamber 62 and the annular chamber 60. The higher specific gravity clear serum 142 of a lipemic serum will gravitate toward the annular chamber 60 while the lower specific gravity chyle material 130 will accumulate toward the inner chamber 62. When the centrifugation operation has been completed, the air traveling through the drive air passage 46 in FIG. 1 is stopped and the support air traveling through the passage 42 will provide support to the rotor 18 as it slows down and will maintain it in a stable condition. The braking apparatus 100 will aid in stopping the rotor by allowing the spring 122 to move the magnets closer to the rotor, since the air supply through the air passage 124 has been stopped. The action of the magnetic field on the rotor slows its rotational speed as set forth in the previously referenced Eddy Current Brake application.

Figure 5:
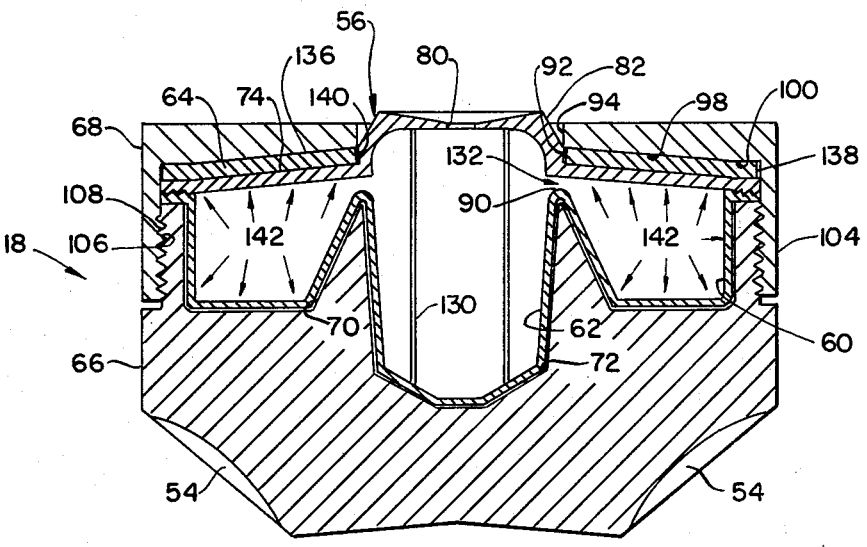
FIG. 5 is a sectional view of the rotor similar to that in FIG. 4, showing the seal between the respective chambers opened to allow fluid communication between the chambers during the centrifugation of the rotor.

As the rotor decelerates and the centrifugally induced pressure forces from the fluid in the annular chamber 60 have been reduced, the sealing element 64 will urge the top portion 74 of the container 56 back into the position shown in FIG. 4, closing the gap 132 and making a seal between the container top 74 and the wall junction 90. The separated clear serum 142 in the annular chamber 60 in FIG. 5 is isolated from the remainder of the fluid mixture containing the chyle material 130 in the inner chamber 62. It should be noted that at some point during the deceleration of the rotor 18, the force of the sealing element 64 overcomes the decreasing centrifugally induced forces of the fluid in the annular chamber 60, so that the top portion 74 of the container will seal the annular chamber 60 from the inner chamber 62 prior to the stoppage of the rotor.

When the rotor 18 has come to rest and has been removed from the rotor housing 14, the turbid fluid mixture containing the chyle can be extracted from the inner chamber 62 by a pipette inserted through the rotor cap aperture 94 and the container top aperture 80. Once the rotor cap 68 is removed, the container 56 holding the clear serum 142 sealed in the annular chamber can be withdrawn. The container 56 assumes the configuration shown in FIG. 3 where the gap 132 is re-established by the semi-flexible material of the container causing the container top 74 to return to its somewhat frustoconical configuration. A pipette can be inserted through both the container top aperture 94 and the gap 132 to extract the clear serum from the annular chamber 60.

Figure 6:
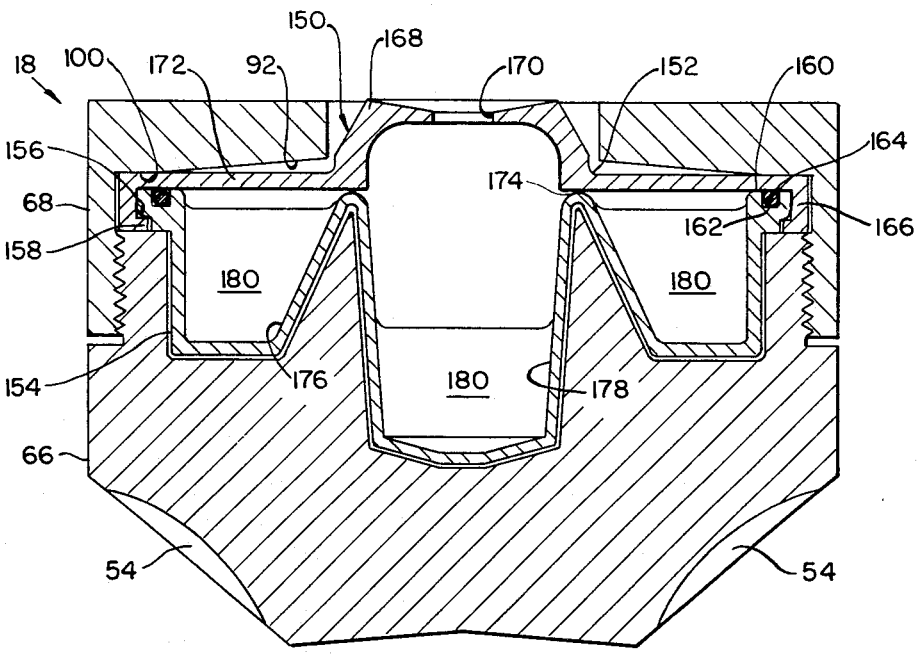
FIG. 6 is a sectional view of an alternate embodiment of the present invention.

An alternate embodiment of the present invention is shown in FIG. 6 where the rotor 18 holds a container 150 having a top section or cover plate 152 which is removably engaged with a lower section 154 by the snap on engagement between the mating recessed shoulder 156 and inward flange 158. The rotor cap 68 and the rotor lower portion 66 have the same exterior and interior configuration as that shown and discussed with respect to FIGS. 1 through 5. The connecting ridge 160 of the container lower portion 154 has a recessed annular groove 162 for receipt of the O-ring seal 164 used to seal the engagement between the top section 152 and lower section 154 of the container 150.

The container top section 152 has a depending annular flange 166 which carries the inward flange 158 for a snap on engagement with the recessed shoulder 156 of the lower section 154. The top section 152 has a raised central portion 168 with a central aperture 170. Extending outward from the raised central portion 168 and integrally formed within the top section 152 is an annular sealing portion or element 172 which is generally semi-flexible and has in its unrestrained condition a generally flat shape with no gap formed between the sealing element 172 and the wall junction 174, blocking fluid communication between the annular and inner chambers 176 and 178. These chambers are of a similar configuration to the chambers 60 and 62 of the container 56 shown in FIGS. 1–5.

In operation, a fluid mixture 180 to be subjected to centrifugation is placed in the annular and inner chambers 176 and 178 when the top section 152 has been removed. The fluid mixture should nearly fill the annular chamber 176. Once the top section has been snapped on to the lower section 154, the container 150 is placed in the rotor 18 where the rotor is subjected to the centrifugation operation as discussed with respect to FIGS. 1–5. The centrifugally induced pressure within the fluid mixture in the annular chamber 176 will exert a force on the sealing portion 172 of the top section 152, causing the semi-flexible material to move into the frustoconical recessed area 92 within the rotor cap 68. This will break the seal between the top section 152 and the wall junction 174, allowing fluid communication between the annular and inner chambers 176 and 178 during the high speed configuration. When the centrifugation has been completed and the centrifugally induced pressure on the fluid within the annular chamber has subsided, the top section sealing portion 172 will again seal with the wall junction 174 to retain the higher specific gravity constituents, which have been separated out of the fluid mixture, in the sealed annular chamber 176. After the container 150 is removed from the rotor 18, the lighter specific gravity portion of the fluid mixture can be removed from the inner chamber 178 through a pipette (not shown) extending into the central aperture 170. The top section 152 can then be disconnected from the lower section 154 of the container to allow access to the annular chamber 176.

Therefore, the FIG. 6 embodiment of the present invention incorporates a top section 152 of the container 150, having integrally formed therein a sealing element 172 which has the same sealing characteristic of the sealing element 64 found in the embodiment of invention shown in FIGS. 1–5.

Figure 7:
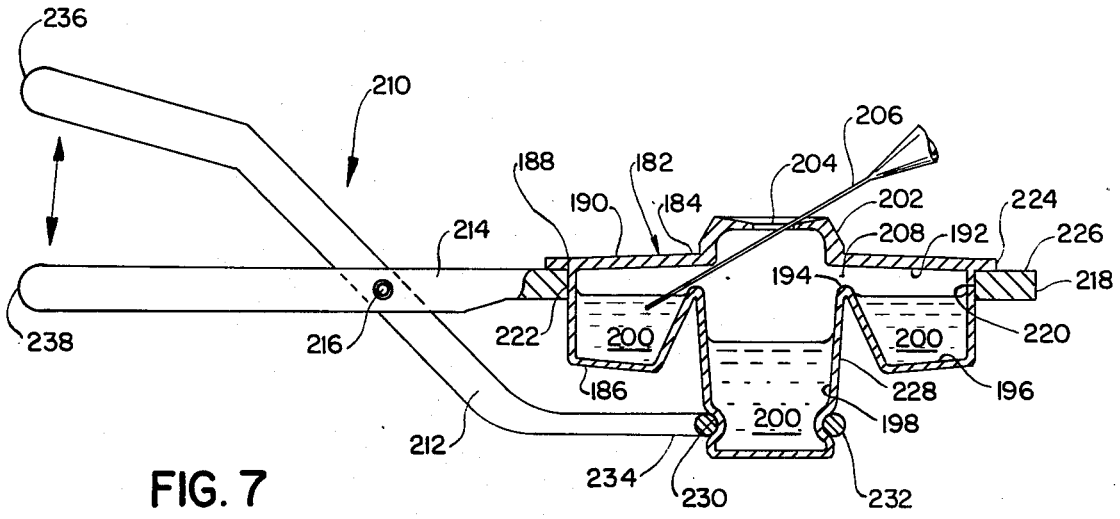
FIG. 7 is a sectional view of a second alternate embodiment of the present invention showing a mechanism for opening a gap between the annular chamber and the central chamber of the rotor container.

A second alternate embodiment of the present invention is shown in FIG. 7. In certain instances it may be desirable to have a container 182 constructed in such a manner that its top portion 184 and its bottom or lower portion 186 are integrally joined or permanently sealed at the junction 188. In this arrangement of the container 182 the container top portion 184 has an annular sealing section 190 which is an integral part of the top portion 184 which is similar in size and function to the sealing portion 172 in the first alternate embodiment of the container shown in FIG. 6. In its normal unrestrained orientation the lower surface 192 of the top portion 184 is in engagement with the wall junction 194, eliminating any gap between the top portion 184 and the wall junction 194. The container 182 has a configuration similar to that of the container 150 in FIG. 6. The container 182 has an annular chamber 196 and an inner or central chamber 198 for receipt of a fluid mixture 200. The top portion 184 of the container has a raised central portion 202 in which is located a central aperture 204. Being of a similar structure as the container 150 shown in FIG. 6, the container 182 in FIG. 7 is designed to operate within a rotor 18 as shown in FIG. 6. During centrifugation, the sealing section 190 will deflect away from the wall junction 194 under the pressure induced by the centrifugal forces of the fluid mixture 200 in the annular chamber 196. This will permit fluid communication between the inner chamber 198 and the annular chamber 196 during centrifugation. As the rotor slows from the centrifugation operation, the sealing section 190 will again seal against the wall junction 194 to retain the separated constituents sealed within the annular chamber.

Because the top portion 184 of the container 182 is integrally formed or permanently sealed with the lower portion 186 and because in its normal unrestrained position the top portion 184 is in engagement with the wall junction 194, it is necessary to induce a gap between the wall junction 194 and the top section 184 to allow for the introduction through a pipette 206 of the fluid mixture 200 into the annular chamber 196. As shown in FIG. 7, one particular arrangement for causing the establishment of a gap 208 between the wall junction 194 and the top section 184 is a plier arrangement 210 having two moving members 212 and 214 pivotally joined to junction 216. The connecting end 218 of the moving member 214 has an annular ring aperture 220 designed to receive the outside surface 222 of the annular portion of the container 182. Further, the diameter of the annular ring aperture 220 is less than the diameter of the outer edge 224 of the top section 184 of the container, permitting the outer edge 224 of the top section 184 of the container to rest on the shoulder 226 adjacent the annular ring aperture 220.

Located on the surface 228 of the central chamber 198 is a recessed annular groove 230 which receives a snap ring 232 attached to the contact end 234 of the moving member 212.

Therefore, the contact end 218 of the moving member 214 is in supporting engagement with the outer surface 222 of the annular chamber 196 while the contact end 234 of the moving member 212 is in secure contact with the surface 228 of the inner chamber 198. By moving the control end 236 of the moving member 212 away from the controlling end 238 of the moving member 214 about the pivot junction 216, the contact end 234 of the moving member 212 will move away from the contact end 218 of the moving member 214. Because the container 182 is composed of a generally flexible material, the wall junction 194 will move away from the bottom or lower surface 192 of the top section 184 to the position shown in FIG. 7 with a gap 208 established. Therefore, it is possible to insert the pipette 206 through the gap 208 and into the annular chamber 196 to allow for the insertion or removal of the mixture 200 located in the annular chamber.

Although the embodiments disclosed herein have shown only one annular chamber, a rotor container may be constructed with more than one annular chamber which can be automatically sealed from the inner chamber to retain separated constituents of a fluid mixture.

It should be noted that a sealing element 64 as shown in FIGS. 1–5 could be molded into the top portion 74 of the container 56 rather than being a separate annular ring member. The top section 152 of the container 150 in FIG. 6 can be made of suitable material to have its own integral sealing element characteristics. Consequently, a container having a permanent sealing junction 78 between the top portion 74 and lower portion 76 as shown in FIGS. 1–5 can be used or a container with a removable top section 152 and O-ring seal 164 shown in FIG. 6 could be used.

It is envisioned that the embodiments of the present invention set forth herein could be structurally modified, but remain within the scope of the invention.

What is claimed is:

1. A rotor for use with a centrifuge, said rotor comprising:

a container having a lower section with at least two chambers positioned within said rotor for receipt of a fluid mixture;

a movable top section portion attached over said lower section of said container, said top section in an unrestrained orientation allowing fluid communication between said chambers; and sealing means mounted adjacent said top section within said rotor for biasing said top section in a juxtaposed position over one of said chambers to seal said one chamber from the other of said chambers to prevent fluid communication between said chambers, said fluid mixture in said one of said chambers exerting a centrifugally induced force on said top section when said rotor is rotating to move said top section against the bias of said sealing member to allow fluid communication between said chambers.

2. A rotor for use with a centrifuge, said rotor comprising:

a generally cylindrical container having at least two chambers positioned within said rotor for receipt of a fluid mixture;

a semi-flexible top section secured over said chambers;

a sealing member mounted adjacent said top section; and a rotor cap secured to said rotor and enclosing said sealing member, said sealing member biasing said top section into sealing engagement with one of said chambers to seal said one chamber from the other chamber when said rotor is stationary, said fluid mixture exerting a centrifugally induced force on said top section when said rotor is rotating to move said top section against said bias of said sealing member to automatically allow fluid communication between said chambers.

3. A rotor as defind in claim 2 wherein said rotor cap comprises a depending flange forming a recessed interior surface to provide an adjustment cavity when said cap is secured to said rotor for movement of said sealing member and said top section in response to said centrifugally induced force of said fluid mixture.

4. A rotor for use with a centrifuge, said rotor comprising:

a generally cylindrical container located within said rotor and having an inner chamber and an annular chamber for receipt of a fluid mixture, said inner chamber and said annular chamber being separated by a wall junction; and a movable cover plate removably secured to said container, said cover plate being in sealing contact with said wall junction to seal said annular chamber from said inner chamber when said rotor is at rest, said cover plate being moved away from said wall junction by centrifugally induced pressure forces of said fluid mixture within said annular chamber during a specific phase of rotation of said rotor to allow fluid communication between said inner and annular chambers.

5. A rotor for use with a centrifuge, said rotor comprising:

a lower rotor portion;

a generally cylindrical container having at least two chambers positioned within said lower rotor portion for receipt of a fluid mixture;

a movable cover plate secured to said container;

a sealing member located adjacent said cover plate; and a rotor cap secured to said lower rotor portion over said container, said rotor cap having a recessed bearing surface substantially perpendicular to the axis of said rotor for holding in conjunction with said lower rotor portion the outer edge of said sealing member in such a manner that said sealing member retains said cover plate sealed over one of said chambers to seal said chambers from each other.

6. A rotor for use with a centrifuge, said rotor comprising:

an annular chamber within said rotor;

an inner chamber within said rotor separated from said annular chamber by a wall junction, said chambers receiving a fluid mixture;

a frustoconical top member located over said chambers;

an annular ring member positioned adjacent said top member, said ring member having an inner edge and outer edge; and a rotor cap removably secured to said rotor to enclose said annular ring member, said rotor cap having a frustoconical recessed area, said rotor cap securing said outer edge of said ring member within said rotor, said inner edge of said ring being movable between a first position and a second position, said inner edge in said first position holding said top member in sealing engagement with said wall junction sealing said annular chamber from said inner chamber, said inner edge in said second position being moved within said frustoconical recessed area of said cap away from said annular chamber by centrifugally induced pressure forces of said fluid mixture within said annular chamber to release the seal between said top member and said wall junction to allow fluid communication between said annular and inner chambers.

* * * * *